US006691722B2

(12) United States Patent
Hutchinson et al.

(10) Patent No.: US 6,691,722 B2
(45) Date of Patent: Feb. 17, 2004

(54) WALKING CANE HOLDER APPARATUS

(75) Inventors: Jack M. Hutchinson, Poplarville, MS (US); Brenda Allen, 140 Demontluzin St., Bay St. Louis, MS (US) 39520

(73) Assignee: Brenda Allen, Bay St. Louis, MS (US)

( * ) Notice: Subject to any disclaimer, the term of this patent is extended or adjusted under 35 U.S.C. 154(b) by 34 days.

(21) Appl. No.: 10/174,069

(22) Filed: Jun. 19, 2002

(65) Prior Publication Data

US 2003/0234035 A1 Dec. 25, 2003

(51) Int. Cl.[7] ..... A45B 1/00

(52) U.S. Cl. ..... 135/65; 224/901.4; 224/901.8; 224/269

(58) Field of Search ..... 135/65, 66; 224/901.4, 224/901.8, 269

(56) References Cited

U.S. PATENT DOCUMENTS

| | | | | |
|---|---|---|---|---|
| 494,123 | A | | 3/1893 | Comins |
| 781,629 | A | | 2/1905 | Ahlstrom |
| 4,884,730 | A | | 12/1989 | Carpenter |
| 4,958,758 | A | * | 9/1990 | Tipple et al. |
| 5,964,385 | A | | 10/1999 | Simon |
| 6,000,414 | A | * | 12/1999 | Crusor |
| 6,056,173 | A | | 5/2000 | Gillespie |
| 6,216,319 | B1 | | 4/2001 | Elkins |
| 6,502,283 | B1 | * | 1/2003 | Aguirre |

FOREIGN PATENT DOCUMENTS

| | | | | |
|---|---|---|---|---|
| JP | 2000-60614 | * | 2/2000 | ..... A45B/1/04 |

* cited by examiner

*Primary Examiner*—Robert Canfield
(74) *Attorney, Agent, or Firm*—William M. Hobby, III

(57) ABSTRACT

A walking cane holder apparatus allows a walking cane to be removably attached to a person's clothing when not being used and also prevents the cane from falling to the ground when dropped by a user. The walking cane has a walking cane holding attachment having an elongated support member having first and second straps connected together. The first strap has a clothing fastener attached thereto and the second strap has a piece of hook and loop material attached thereto. A piece of hook and loop material is attached to the walking cane for releasably attaching the walking cane to the holding attachment second strap a piece of hook and loop material and has one end of an elongated, flexible, resilient cord attached thereto. The resilient cord has a piece of hook and loop material attached to the other end thereof. The elongated support member can be removably attached to a person's clothing and the elongated flexible resilient cord hook and loop member can be removably attached to the second strap piece of hook and loop material to allow the walking cane to be held by the cord if the cane is dropped. The cane can also be supported to a person when not in use by the hook and loop member attached to the walking cane being removably attached to the second member piece of hook and loop material.

10 Claims, 2 Drawing Sheets

WALKING CANE HOLDER APPARATUS

BACKGROUND OF THE INVENTION

Many individuals who require the help of a cane when walking do not have the ability to recover a cane when it is accidentally dropped or misplaced. They may be lacking in agility or vision or both. To assist those individuals, it would useful to provide a means for recovering the drop of a cane that would not interfere with the use of the cane and that would not be displaced by the motions involved in walking with a cane. In addition, after arriving at a chosen destination, many cane users will need to store their cane in a location where it will remain until needed. The storage may be temporary, such as while writing a check or performing some other temporary function, and in many cases, there is no readily available place to temporarily store the cane while performing a simple function.

In U.S. Pat. No. 4,884,730, a belt mounted retractable leash is attached to the cane to enable the user of the cane to retrieve the cane if accidentally misplaced or dropped. This device utilizes a spring-loaded pulley that draws the cane towards a user's belt when the cane is released. This type of device leaves the hands unencumbered but tends to constantly pull the cane towards a user's waist.

In U.S. Pat. No. 5,964,385, a cane retrieval device includes a flexible linking member that retractably joins a cane to a wrist mounted attachment strap. A constant tension spring control positioning assembly allows placement of a tethered cane in a user's selected location remote from the user's hand while drawing the cane into a readily grasped orientation.

U.S. Pat. No. 781,629 shows an umbrellas, glove, or handkerchief holder which can be attached with a clip to a belt or to a person's jacket pocket for holding an umbrella, glove or handkerchief to a person's clothing.

These prior patents show the use of cane or umbrella holders which can be attached to a person's clothing or to the person's body. The prior cane holders use a retractable reel for holding the cane. There is a need for a simple cane holder which can support the cane to a person's clothing while the cane user is performing temporary functions, such as writing a check or the like, and which, at the same time, will allow the individual user to recover a cane when it is accidentally dropped or misplaced. It is accordingly an aim of the present invention to provide a walking cane holder which is useful in recovering a dropped or misplaced cane that will not interfere with the use of the cane and, at the same time, provide temporary storage for the cane attached to a user's clothing so as to free the hands of the cane user while performing these functions.

SUMMARY OF THE INVENTION

A walking cane holder apparatus allows a walking cane to be removably attached to a person's clothing when not being used and also prevents the cane from falling to the ground when dropped by a user. The walking cane has a walking cane holding attachment having an elongated support member having first and second straps connected together. The first strap has a clothing fastener attached thereto and the second strap has a piece of hook and loop material attached thereto. A piece of hook and loop material is attached to the walking cane for releasably attaching the walking cane to the holding attachment second strap a piece of hook and loop material and has one end of an elongated, flexible, resilient cord attached thereto. The resilient cord has a piece of hook and loop material attached to the other end thereof. The elongated support member can be removably attached to a person's clothing and the elongated flexible resilient cord hook and loop member can be removably attached to the second strap piece of hook and loop material to allow the walking cane to be held by the cord if the cane is dropped. The cane can also be supported to a person when not in use by the hook and loop member attached to the walking cane being removably attached to the second member piece of hook and loop material.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
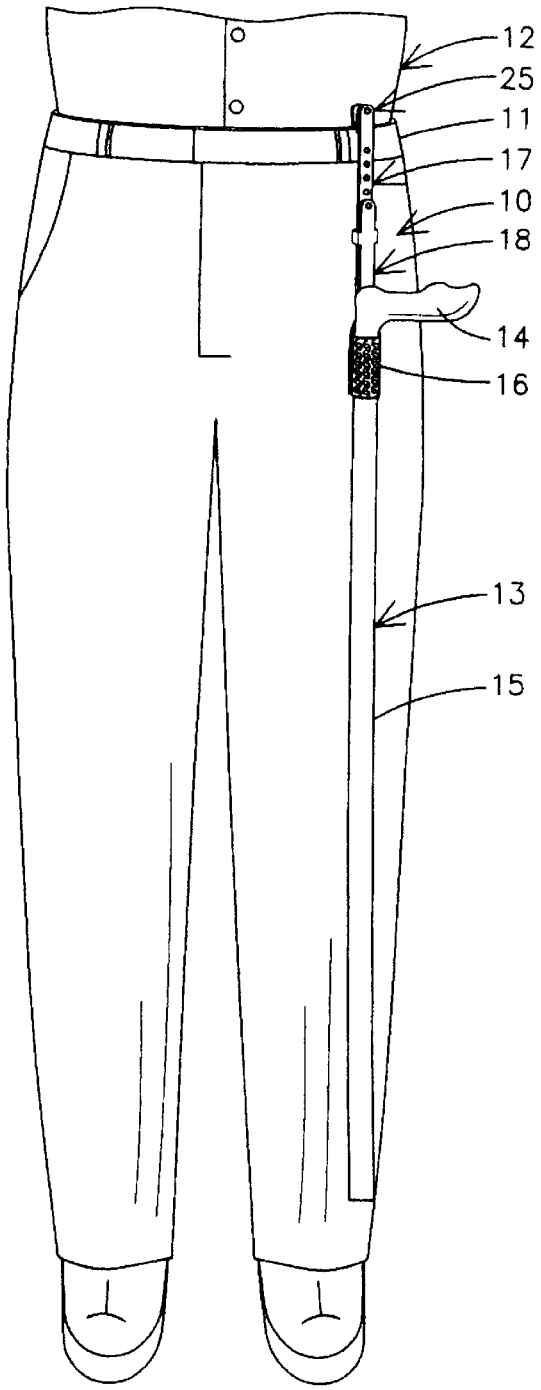
FIG. 1 is a perspective view of a walking cane held to a person's clothing by a walking cane holder in accordance with the present invention.
Figure 2:
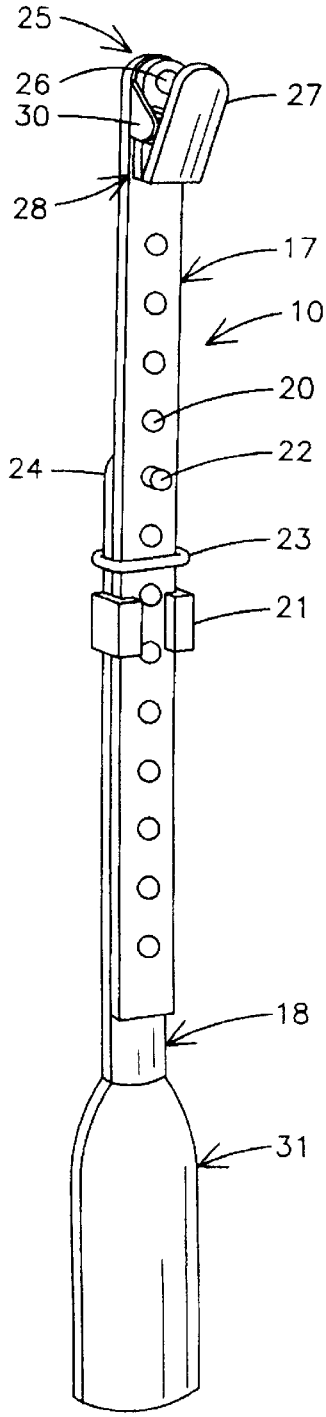
FIG. 2 is a perspective view of the walking cane holder support strap.
Figure 3:
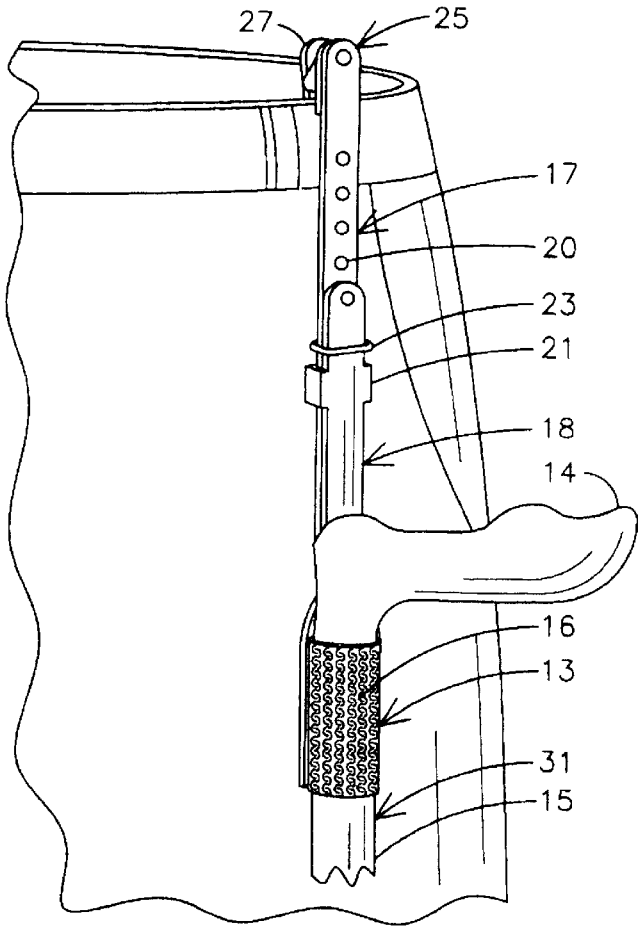
FIG. 3 is a partial perspective view of a walking cane supported by the strap of FIG. 2 to a person's clothing.

Referring to the drawings FIGS. 1–4, a walking cane holding device 10 is shown in FIG. 1 attached to garment or belt 11 of an individual 12 supporting a walking cane 13. Walking cane 13 has a handle 14 and an extended barrel portion 15 and has a strip of hook and loop material 16 attached around the barrel portion 15, as seen in FIGS. 1 and 3. The holding member 10 can be seen as having a strap 17 and a strap 18 connected together. The strap 17 has a plurality of openings 20 therein while the strap 18 has a belt loop member 21. This allows the strap 17 to be slipped through loop 21 of the strap 18 and aligned with a stud or knob 22 which can be slipped into one of the plurality of holes 20 for holding the straps together. The plurality of holes 20 allow the straps 17 to be slid and adjusted to adjust the attached straps to any length desired. It also allows the strap 17 to be reversed and still attached to strap 18. An O-ring 23 may also be utilized to hold the loose strap portion 24 of strap 18 adjacent the strap 17. Strap 17 has a clothes fastener 25 attached thereto with a pivot pin 26 that allows it to rotate 180 degrees. The fastener 25 is a spring fastener which is opened by pushing the handle portion 27 to open the jaws 28. The fastener 25 may also have a plastic tab 30 to retain the clip in the position shown. Thus, the fastener 25 can be in the position shown and can be attached to an individual's belt or garment as illustrated in FIG. 1 or 3 and can be rotated 90 degrees and reversed for attaching to a person's shirt or other clothing. The strap 18 has an end portion 31 which is a generally arcuate portion for fitting the tubular shape of the cane 13 barrel portion 15 so that the cane will nest within the cane support portion 31. The hook and loop strip 32 is mounted within the arcuate cane holding portion. The hook and loop strip 32 can have a second strip 33 which can all be one strip if desired. When the holding member 10 is attached to the clothing, as shown in FIGS. 1 and 3, the walking cane 13 can have the piece of hook and loop material 16 placed within the nesting arcuate support surface 31 as shown in FIGS. 1 and 3 so that the hook and loop material 16 engages the hook and loop material 32.

Figure 4:
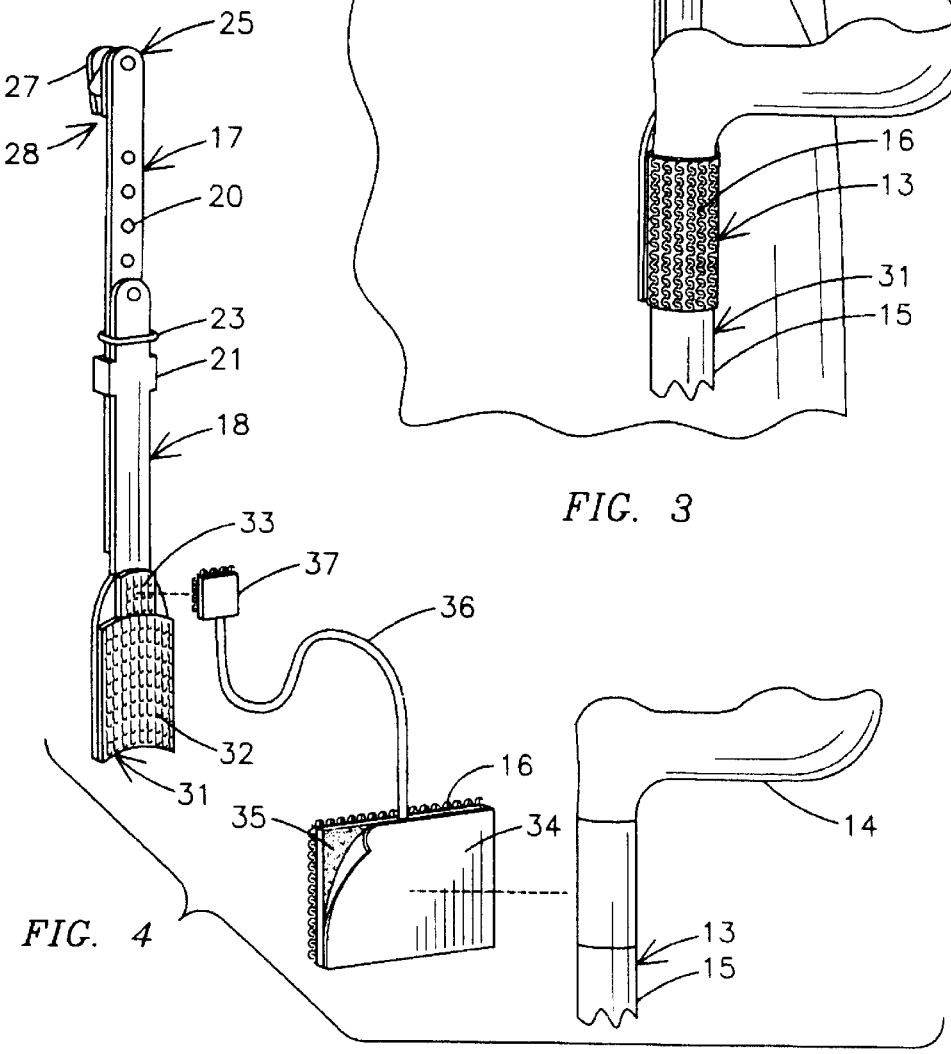
FIG. 4 is an exploded perspective view of the walking cane holder and walking cane.

As more clearly seen in FIG. 4, the hook and loop material 16 wraps around the cane can initially be provided with a peel off cover 34 covering an adhesive surface 35 for wrapping around and attaching to the cane 13 and has a resilient flexible cord 36 attached thereto having a piece of hook and loop material 37 attached to one end. The hook and loop material 37 is attached to the hook and loop portion 33 so that when the cane is in use, the resilient cord, which can be an elastic cord or a bungy cord, is connected between the cane 13 and the cane holder attachment 10 while the cane is in use to allow the user to recover a dropped cane which is then supported by the flexible resilient cord 36. By having the hook and loop piece 37 at one end forming the attachment with the hook and loop material 33, the resilient cord 36 can be rapidly disconnected for storage of the cane or when the cane is not in use. Thus, the present walking cane holder advantageously allows the temporary storage or holding of the walking cane 13 to a person's belt or clothing, as shown in FIGS. 1 and 3, and then allows for the quick grasping of the cane when needed by the user and simultaneously allows for the recovery of a dropped cane when the resilient cord 16 is attached to the walking cane holder 10. The walking cane holding device 10 stores on the cane with the hook and loop member 32 on the strap 18 attached to the hook and loop piece 16 on the cane ready for use the next time the cane is used.

It should be clear at this time that an elongated support member can be removably attached to a person's clothing which has an elongated flexible resilient cord having hook and loop material on one end for removably attaching to the elongated support member for recovering a dropped cane while the walking cane holding attachment can have an attachment for supporting the cane to the person's clothing when the cane is not in use with a hook and loop material attachment making the cane readily available and readily recoverable if dropped. However, the present invention is not to be construed as limited to the forms shown which are to be considered illustrative rather than restrictive.

We claim:

1. A walking cane holder comprising:

a walking cane;

a walking cane holding attachment having an elongated support member having at one end a fastener for attaching to a person's clothing and having a first piece of hook and loop material on the other end thereof;

a second piece of hook and loop material attached to said walking cane for releasably attaching said walking cane to said holding attachment first piece of hook and loop material, said second piece of hook and loop material having one end of an elongated flexible member attached thereto and having a third piece of hook and loop material attached to the other end thereof;

whereby said elongated support member can be removably attached to a person's clothing and said elongated flexible member third piece of hook and loop material can be removably attached to said elongated support member first piece of hook and loop material for holding said cane when dropped and whereby said cane can be supported to a person when not in use by said second piece of hook and loop material attached to said walking cane being removably attached to said elongated support member first piece of hook and loop material.

2. The walking cane holder in accordance with claim 1 in which said walking cane holding attachment elongated support member has first and second straps connected together, said first strap having said clothing fastener attached thereto and said second strap having said first piece of hook and loop material attached thereto.

3. The walking cane holder in accordance with claim 2 in which said walking cane holding attachment first and second straps are adjustably connected together to vary the length of said elongated support member.

4. The walking cane holder in accordance with claim 2 in which said walking cane holding attachment first strap clothing fastener is a clip fastener rotatably attached thereto for positioning said first strap for attaching to a person's shirt or belt.

5. The walking cane holder in accordance with claim 4 in which said walking cane holding attachment first strap is reversibly attachable to said second strap.

6. The walking cane holder in accordance with claim 5 in which said walking cane holding attachment second strap has an arcuate surface on one end thereof having said first piece of hook and loop material attached thereto for nesting said cane therein when supported thereon.

7. The walking cane holder in accordance with claim 1 in which said elongated flexible member is a resilient flexible cord.

8. The walking cane holder in accordance with claim 5 in which said walking cane holding attachment first strap has a plurality of holes therein and said second strap has a protruding knob for selectively inserting into one of said plurality of openings in said first strap to hold said first and second straps together.

9. The walking cane holder in accordance with claim 8 in which said walking cane holding attachment second strap has a loop thereon for sliding said first strap thereinto.

10. The walking cane holder in accordance with claim 1 in which said second piece of hook and loop material is adhesively attached around said walking cane.

* * * * *